US007647734B2

(12) United States Patent
Sarkisian

(10) Patent No.: US 7,647,734 B2
(45) Date of Patent: Jan. 19, 2010

(54) SEISMIC STRUCTURAL DEVICE

(75) Inventor: Mark P. Sarkisian, San Anselmo, CA (US)

(73) Assignee: Skidmore Owings & Merrill LLP, New York, NY (US)

( * ) Notice: Subject to any disclaimer, the term of this patent is extended or adjusted under 35 U.S.C. 154(b) by 150 days.

(21) Appl. No.: 11/751,156

(22) Filed: May 21, 2007

(65) Prior Publication Data

US 2008/0289268 A1 Nov. 27, 2008

(51) Int. Cl.

| | |
|---|---|
| ***E04H 9/02*** | (2006.01) |
| ***B66B 7/02*** | (2006.01) |
| ***B25G 3/00*** | (2006.01) |
| ***F16M 1/00*** | (2006.01) |
| ***A47B 96/00*** | (2006.01) |

(52) U.S. Cl. ..... 52/167.3; 403/14; 187/406; 187/408; 248/218.4; 248/220.21; 248/225.11; 248/638; 248/674

(58) Field of Classification Search ..... 52/167.1–167.9; 403/150, 151, 13, 14; 187/406, 408; 248/637, 248/638, 674, 218.4, 220.21, 220.22, 220.31, 248/220.41, 228.1, 223.31, 222.41, 225.11
See application file for complete search history.

(56) References Cited

U.S. PATENT DOCUMENTS

| | | | | | |
|---|---|---|---|---|---|
| 2,990,920 | A * | 7/1961 | Hoffman, Jr. | ..... | 52/633 |
| 3,490,797 | A * | 1/1970 | Platte | ..... | 52/282.1 |
| 3,798,865 | A * | 3/1974 | Curtis | ..... | 52/665 |
| 4,035,093 | A * | 7/1977 | Redshaw | ..... | 403/4 |
| 4,557,457 | A * | 12/1985 | Cockfield et al. | ..... | 248/544 |
| 4,577,729 | A * | 3/1986 | Karol | ..... | 187/408 |
| 5,029,790 | A * | 7/1991 | Payne | ..... | 248/287.1 |
| 5,048,243 | A * | 9/1991 | Ward | ..... | 52/167.4 |
| 5,375,382 | A * | 12/1994 | Weidlinger | ..... | 52/167.3 |
| 5,420,762 | A * | 5/1995 | Lewis | ..... | 362/549 |
| 5,720,571 | A * | 2/1998 | Frobosilo et al. | ..... | 403/403 |
| 5,846,018 | A * | 12/1998 | Frobosilo et al. | ..... | 403/403 |
| 5,876,006 | A * | 3/1999 | Sharp et al. | ..... | 248/297.21 |
| 6,196,356 | B1 * | 3/2001 | Sneed | ..... | 187/408 |
| 6,213,679 | B1 * | 4/2001 | Frobosilo et al. | ..... | 403/403 |
| 6,681,538 | B1 * | 1/2004 | Sarkisian | ..... | 52/289 |
| 7,293,393 | B2 * | 11/2007 | Kelly et al. | ..... | 52/665 |
| 7,306,191 | B1 * | 12/2007 | Chen | ..... | 248/228.7 |
| 2004/0118075 | A1 * | 6/2004 | Zadeh | ..... | 52/715 |
| 2005/0088000 | A1 * | 4/2005 | Sigears | ..... | 294/1.1 |
| 2005/0148916 | A1 * | 7/2005 | Nathanson | ..... | 602/16 |
| 2005/0284041 | A1 * | 12/2005 | Chen | ..... | 52/167.5 |
| 2008/0289268 | A1 * | 11/2008 | Sarkisian | ..... | 52/167.9 |

* cited by examiner

*Primary Examiner*—Richard E Chilcot, Jr.
*Assistant Examiner*—Andrew J Triggs
(74) *Attorney, Agent, or Firm*—Sonnenschein Nath & Rosenthal LLP

(57) ABSTRACT

A link-fuse joint resists bending moments and shears generated by seismic loading. A joint connection includes a first plate assembly having a first connection plate including a first diagonal slot formed therethrough. A second plate assembly has a second connection plate including a second diagonal slot formed therethrough. The second diagonal slot is diagonally opposed to the first diagonal slot. The second connection plate is position such that at least a portion of the second diagonal slot aligns with a portion of the first diagonal slot. A pin is positioned through the first diagonal slot and the second diagonal slot. The joint connection accommodates a slippage of at least one of the first and second plate assemblies relative to each other when the joint connection is subject to a seismic load and without significant loss of clamping force.

17 Claims, 10 Drawing Sheets

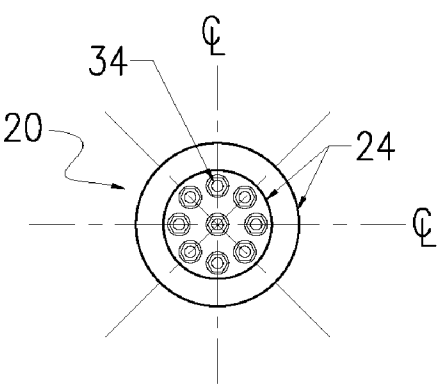
FIG. 7a
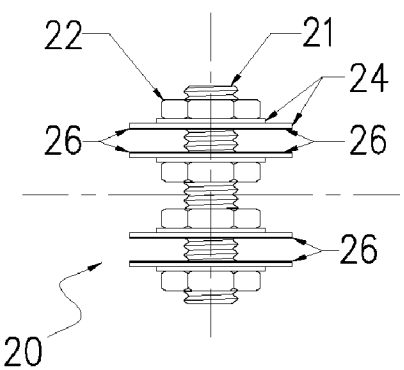
FIG. 7
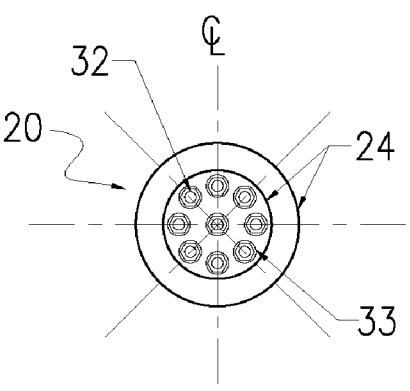
FIG. 8a
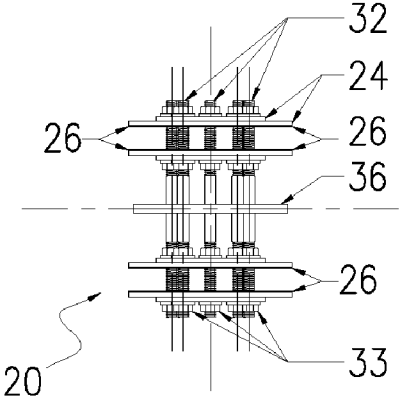
FIG. 8
FIG. 9a
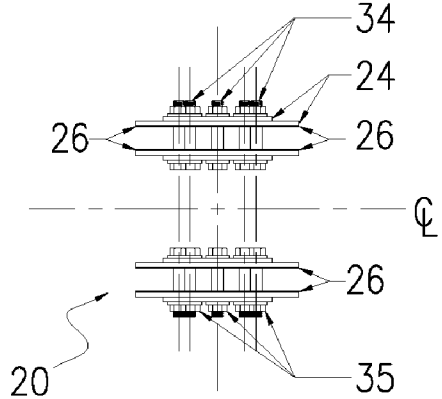
FIG. 9

SEISMIC STRUCTURAL DEVICE

BACKGROUND OF THE INVENTION

1. Field of the Invention

The present invention generally relates to a link beam joint that is utilized in a structure that is subject to seismic loads. In particular, the link beam joint is a link-fuse joint that lengthens dynamic periods and reduces the forces that must be resisted within shear wall or frame construction of structures so that the walls or frames can withstand seismic activity without sustaining significant damage.

2. Description of the Related Art

Structures have been constructed, and are being constructed daily, in areas subject to seismic activity. Special considerations must be given to the design of such structures. In addition to normal loading conditions, the walls and frames of these structures must be designed not only to accommodate normal loading conditions, but also those loading conditions that are unique to seismic activity. For example, link beams within shear walls are typically subject to cyclic motions during seismic events. To withstand such loading conditions, structures subject to seismic activity must behave with ductility to allow for the dissipation of energy under those extreme loads.

In conventional systems, reinforced link beams subject to seismic loads have been designed with the beams fully connected directly to reinforced concrete shear walls with fully developed reinforcing bars. These beams are designed to elastically resist service wind and frequent earthquake events and are designed to plastically perform or hinge during severe earthquake events.

Since link beam length-to-depth ratios are relatively small, shear will typically control the behavior of the beams. For large shear forces, diagonal reinforcement arranged in elevation in the shape of an "X" is typically required. In other cases where shear forces are large, embedded structural steel members are placed within the reinforced concrete beams to resist the load. In all cases, these beams are designed to permanently deform in a severe seismic event. Reinforcing bars and structural steel, if used permanently, deform and concrete cracks or spalls. Energy is dissipated and beams act with ductility but plastically deform with conventional designs.

In steel braced frames, steel beams located between braces are designed to fuse during extreme seismic events. The behavior is similar to beam links used in eccentrically braced frames. These beams are designed to yield and plastically deform, protecting the bracing members and columns and the overall integrity of the structure.

Although current link beam designs may be able to withstand a seismic event, the damage caused by the joints' inability to function elastically, raises serious questions about whether conventional structures can remain in service after enduring seismic events. A need therefore exists for shear wall and steel braced frame structures that can withstand a seismic event without experiencing significant beam or joint failure, so that the integrity of the structure remains relatively undisturbed even after being subject to seismic activity.

SUMMARY OF THE INVENTION

A "link-fuse" joint consistent with the present invention enables a shear wall or steel braced frame to withstand a seismic event without experiencing significant beam or joint failure. The link-fuse joint is also referred to as a joint connection herein. The link-fuse joint is generally utilized in a link beam assembly. The link-fuse joint may be incorporated, for example, into the reinforced concrete shear walls or steel braced frames of a building or other structure subject to seismic activity and improves the structure's dynamic characteristics by allowing the link-fuse joint to slip under extreme loads. This slippage changes the structure's dynamic characteristics by lengthening the structure's fundamental period and softening the structure, which allows the structure to exhibit elastic properties during seismic events. By utilizing the link-fuse joint, it is generally not necessary to use shear walls or steel frames and link beams as large as typically used for a similar sized structure to withstand an extreme seismic event. Accordingly, overall building costs can also be reduced through the use of a link-fuse joint consistent with the present invention.

The link-fuse joint may be employed in a link beam, where the beam attaches to neighboring walls or frames of a structure. In the link-fuse joint, a plate assembly within a beam is designed to mate and be held together by a pin assembly extending through connection plates that extend outward from the plate assembly. Additionally, the plate assembly has diagonally opposed slots. The plate assembly may be secured together, for example, by a threaded rod, multiple threaded rods, multiple high-strength steel bolts, and the like. These connections allow for the slotted plates to slip relative to each other when subject to extreme seismic loads without a significant loss in clamping force. Movement in the joint may be further restricted by treating the faying surfaces of the plate assembly with brass. The brass shims used within the connection possess a predetermined load-displacement behavior and excellent cyclic attributes.

The friction developed from the clamping force within the plate assembly with the brass shims against the steel surface prevents the joint from slipping under most service loading conditions, such as those imposed by wind, gravity, and moderate seismic vents. The threaded rod(s) or high-strength bolts are torqued to provide a slip resistant connection by developing friction between the connected surfaces. However, under extreme seismic loading condition, the level of force applied to the connection exceeds the product of the coefficient of friction times the normal rod or bolt clamping force, which causes the joint to slip in a planer direction while maintaining connectivity.

The sliding of the joint during seismic events provides for the transfer of shear forces and bending moment from the link beams to the shear walls or braced frames. This sliding dissipates energy, which is also known as "fusing." This energy dissipation reduces potential damage to the structure due to seismic activity.

In accordance with devices consistent with the present invention, a joint connection is provided. The joint connection comprises a first plate assembly having a first connection plate including a first diagonal slot formed therethrough. A second plate assembly has a second connection plate including a second diagonal slot formed therethrough. The second diagonal slot is diagonally opposed to the first diagonal slot. The second connection plate is position such that at least a portion of the second diagonal slot aligns with a portion of the first diagonal slot. A pin is positioned through the first diagonal slot and the second diagonal slot. The joint connection accommodates a slippage of at least one of the first and second plate assemblies relative to each other when the joint connection is subject to a seismic load and without significant loss of clamping force.

Although a joint connection consistent with the present invention will slip under extreme seismic loads to dissipate the energy, the joints will, however, remain elastic due to their construction. Furthermore, the joint generally does not becomes plastic nor yields when subjected to the loading and the slip. This allows, for example, a shear wall structure utilizing the joint connection to remain in service after enduring a seismic event and resist further seismic activity.

Other features of the invention will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE DRAWINGS

The accompanying drawings, which are incorporated in an constitute a part of this specification, illustrate an implementation of the invention and, together with the description, serve to explain the advantages and principles of the invention. In the drawings.

FIG. 7 is a side view of a single threaded thru-rod pin assembly;

FIG. 8 is a side view of a multiple threaded thru-rod pin assembly;

FIG. 9 is a side view of a multiple high-strength bolt pin assembly;

Corresponding reference characters indicate corresponding parts throughout the several views of the drawings.

DETAILED DESCRIPTION OF THE INVENTION

Reference will now be made in detail to an implementation in accordance with a link-fuse joint consistent with the present invention as illustrated in the accompanying drawings. The link-fuse joint enables a shear wall or steel braced frame to withstand a seismic event without experiencing significant beam or joint failure. The link-fuse joint may be incorporated, for example, into the reinforced concrete shear walls or steel braced frames of a building or other structure subject to seismic activity and improves the structure's dynamic characteristics by allowing the link-fuse joint to slip under extreme loads. This slippage changes the structure's dynamic characteristics by lengthening the structure's fundamental period and softening the structure, which allows the structure to exhibit elastic properties during seismic events. By utilizing the link-fuse joint, it is generally not necessary to use shear walls or steel frames and link beams as large as typically used for a similar sized structure to withstand an extreme seismic event. Accordingly, overall building costs can also be reduced through the use of a link-fuse joint consistent with the present invention.

Figure 1:
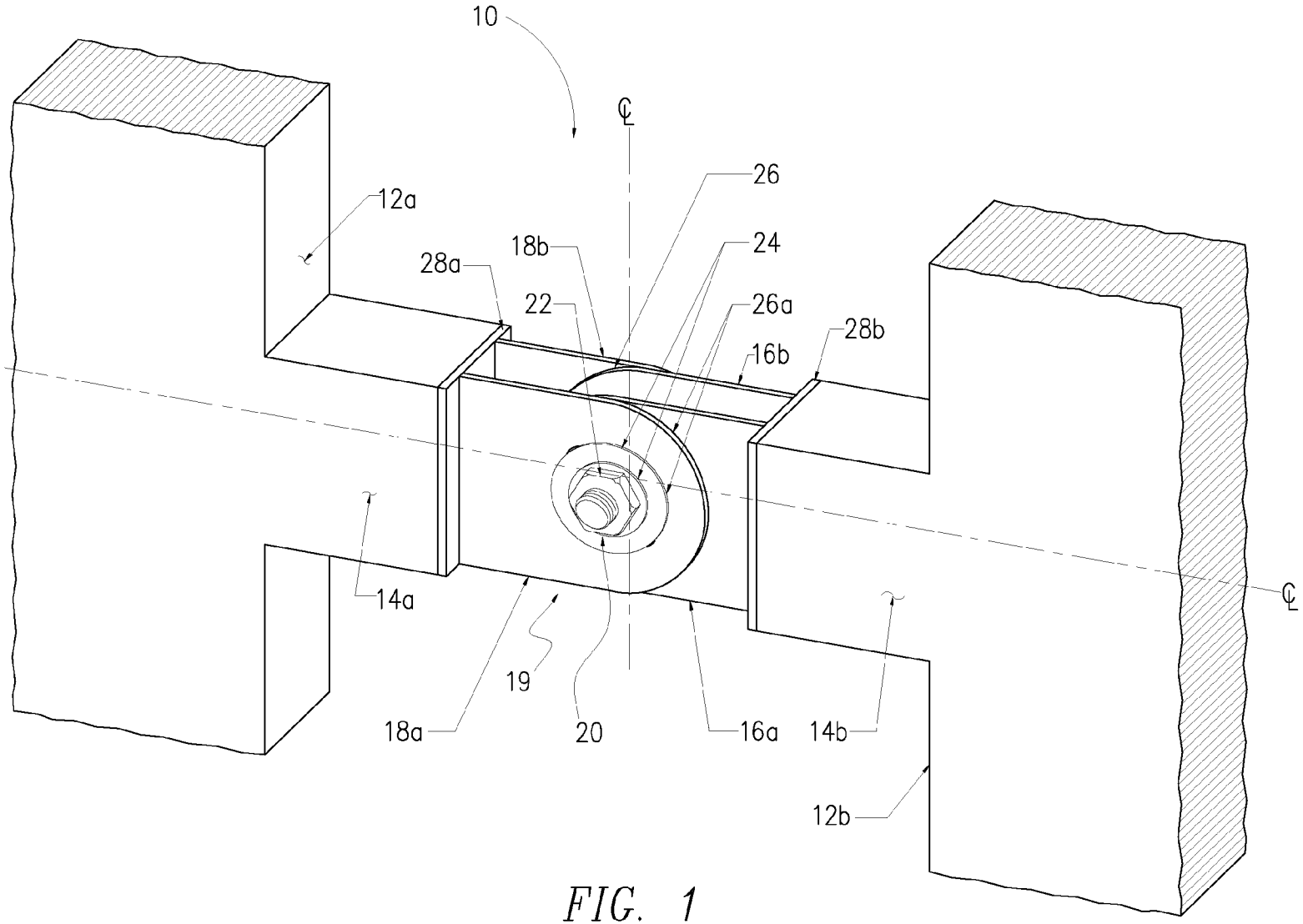
FIG. 1 is a perspective view of one embodiment of a link beam joint assembly consistent with the present invention.

FIG. 1 is a perspective view of one embodiment of a link beam joint assembly 10 consistent with the present invention. Although the illustrative embodiment of FIG. 1 is described as applied to a structure consisting of reinforced concrete, one skilled in the art may also utilize a link-fuse joint 19 in structures comprising other materials, such as structural steel and/or composite materials, e.g., a combination of structural steel and reinforced concrete. The link-fuse joint may be used between columns within a braced frame, for example.

As seen in FIG. 1, the illustrative link beam joint assembly 10 includes walls 12*a* and 12*b* connected via beams 14*a* and 14*b*. In the illustrative example, the walls 12*a*, 12*b* are reinforced concrete walls. The walls may alternatively comprise different materials, such as steel columns and the like. The beams may be, for example, concrete beams, steel beams, and the like. Embedded plates 28*a*, 28*b* are secured to a respective beam 14*a*, 14*b*, for example by being welded to the beam and/or secured within the beam's concrete material. Spaced-apart connection plates 16*a*, 16*b* extend from an end of embedded plate 28*b*. Spaced-apart connection plates 18*a*, 18*b* extend from an end of embedded plate 28*a*. The connection plates may be, for example, steel plates and the like and connect to the embedded plate, for example, by being welded to the embedded plate.

Connection plates 16*a*, 16*b* and connection plates 18*a*, 18*b* are connected to each other via a link-fuse joint 19. To create the link-fuse joint 19, the respective connection plates 16*a*, 16*b* and 18*a*, 18*b* are connected to each other via a pin assembly 20 that extends through the sets of connection plates 16*a*, 16*b* and 18*a*, 18*b*. The pin assembly 20 may comprise, for example, structural steel or another suitable material. In the illustrative example, connection plates 16*a*, 16*b* are positioned as inner plates between outer connection plates 18*a*, 18*b*. Each set of inner connection plates 16*a*, 16*b* and outer connection plates 18*a*, 18*b* abut against one another when the joint 19 is complete. As further described below, connecting the connection plates 16*a*, 16*b* and 18*a*, 18*b* together via the pin assembly 20 through opposing slots 30 and 31 in plates 16*a*, 16*b* and 18*a*, 18*b*, respectively, creates the link-fuse joint 19 consistent with the present invention.

In the illustrative example, there are two connection plates 16*a* and 16*b* that abut against two connection plates 18*a* and 18*b*. One having skill in the art will appreciate that each side of the link-fuse joint may comprise a different number of connection plates. For example, one side of the joint may include two connection plates 16*a* and 16*b* and the opposite side of the joint may include a single, wider connection plate 18. There may be one or more connection plates on each side of the joint. Further, there may be a different number of connection plates on each side of the joint.

Figure 2:
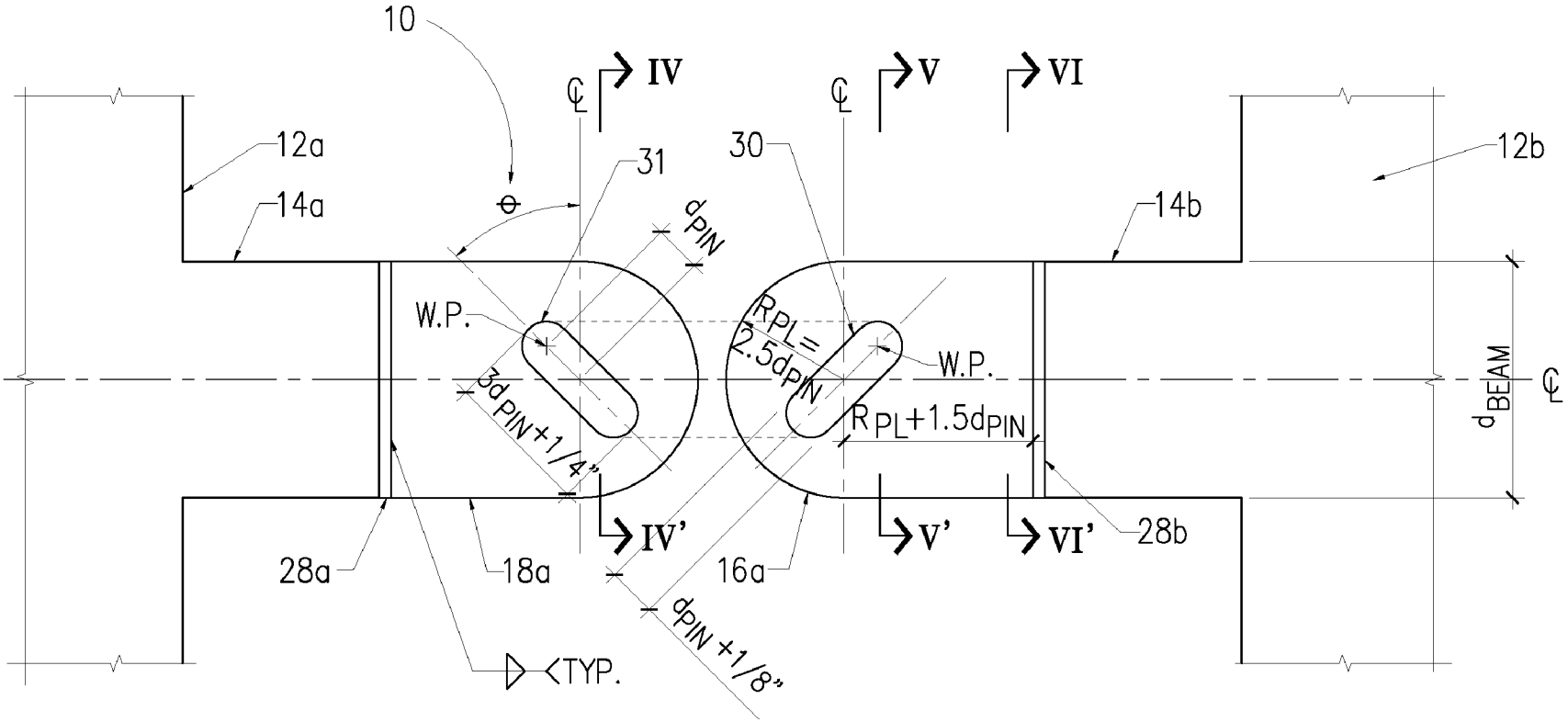
FIG. 2 is an exploded front view of the link beam joint assembly illustrated in FIG. 1.

FIG. 2 is an exploded front view of the link beam joint assembly 10 illustrated in FIG. 1. This view illustrates the connection plates 16*a* and 18*a* as they would appear when the joint 19 is disconnected. In the illustrative example, the connection plates 16*a* and 18*a* are welded to the respective embedded plates 28*a*, 28*b* and extend away from the embedded plates.

Inside connection plates 16*a*, 16*b* and outside connection plates 18*a*, 18*b* each include a diagonal slot 30 and 31, respectively. These slots are diagonally opposed with a reference angle θ, typically 0° to 90°. These diagonally opposed slots allow for an imposed lateral or vertical moment in the plane of the walls 12*a* and 12*b*.

Figure 2A:
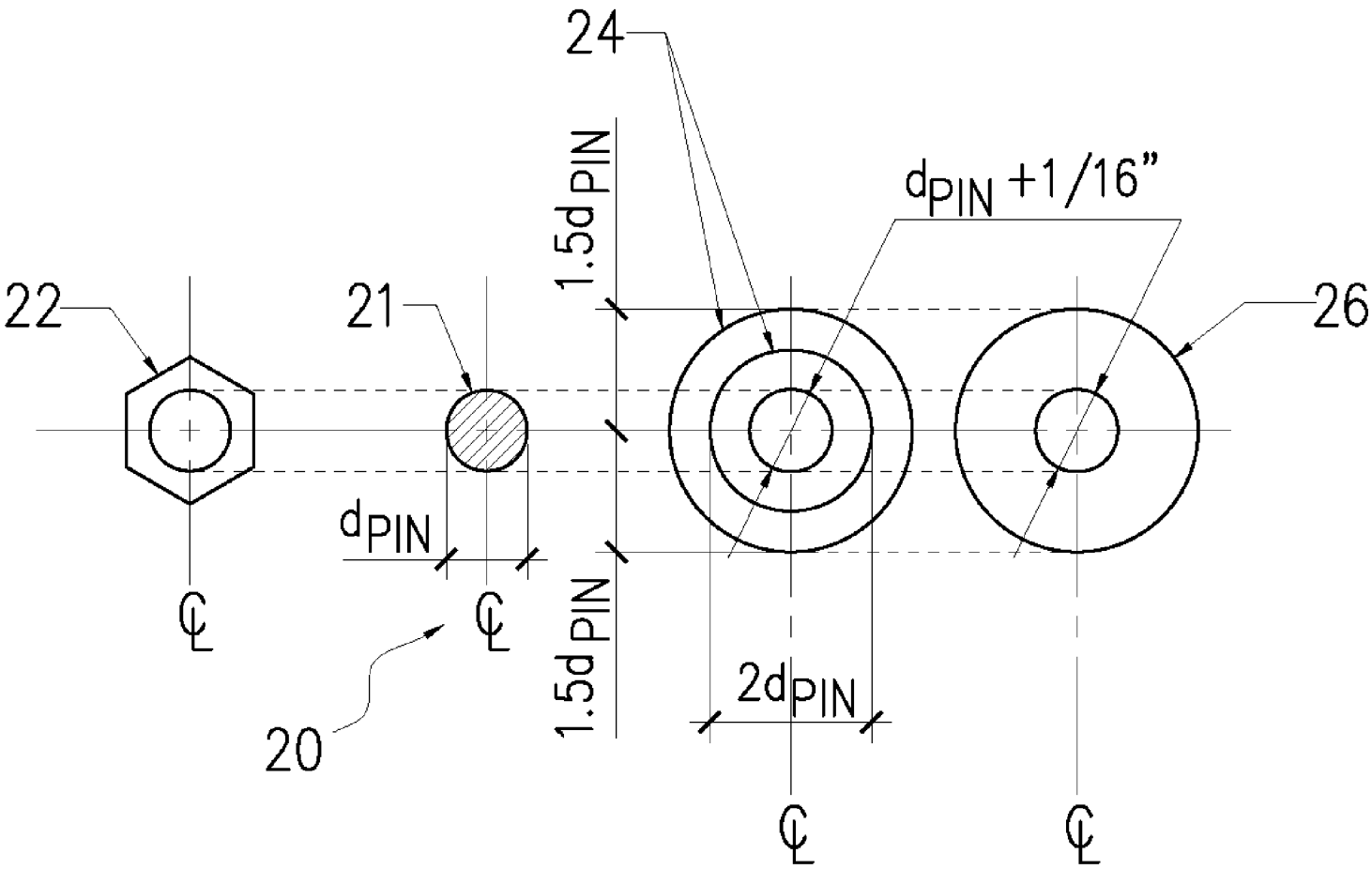
FIG. 2*a* is a front view of a pin assembly used to connect the slotted plate assembly.

FIG. 2*a* is a front view of an illustrative pin assembly 20, which includes a structural steel pin (or threaded rod) 21, four steel nuts 22, and eight steel washers 24. The pin 21 is inserted into the diagonal slots 30 and 31 in the connection plates 16*a*, 16*b* and 18*a*, 18*b*. The pin 21 is then restrained to the connection plates with steel washers 24 and torqued steel nuts 22. The steel washers 24 are located under the steel nuts 22. The pin 21 is aligned through diagonally opposite slots 30 and 31. One having skill in the art will appreciate that the pin assembly components may comprise materials other than those described above with respect to the illustrative example. Further, the pin assembly configuration may be adapted to include fewer or a greater number of components, such as additional washers or nuts.

Figures 3, 3A:
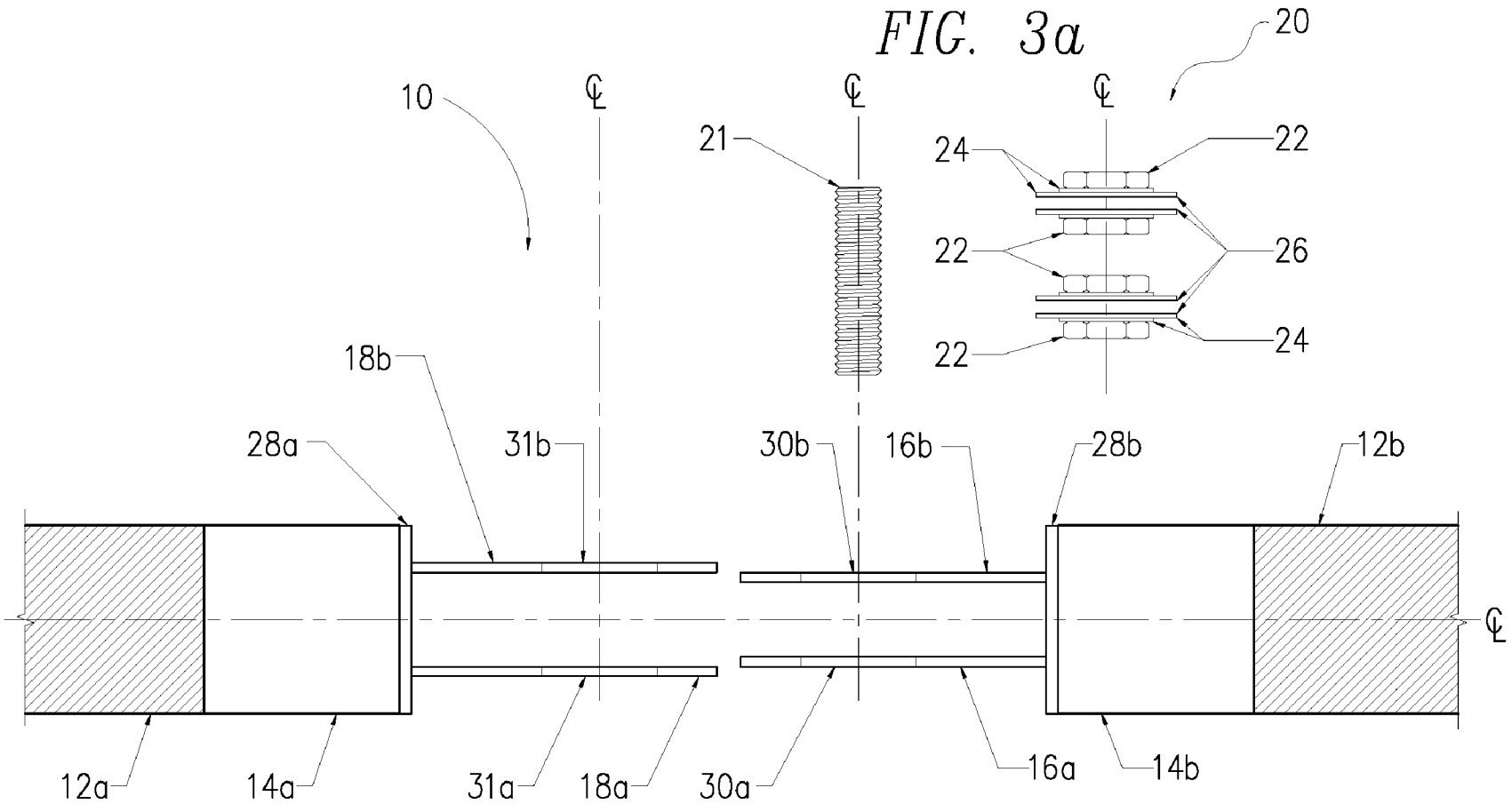
FIG. 3 is an exploded top view of the link beam joint assembly illustrated in FIG. 1.
FIG. 3*a* is a side view of the pin assembly used to connect the slotted plate assembly.

FIG. 3 is an exploded top view of the link beam joint assembly 10 illustrated in FIG. 1. This view depicts the placement of the inner connection plates 16*a*, 16*b* and the outer connection plates 18*a*, 18*b*. The position of the diagonal slots 30 and 31 is also shown in this figure. As illustrated, connection plate 16*a* includes slot 30*a*, connection plate 16*b* includes slot 30*b*, connection plate 18*a* includes slot 31*a*, and connection plate 18*b* includes slot 31*b*. In the illustrative example, the connection plates 16*a*, 16*b* and 18*a*, 18*b* extend directly outward from the embedded plates 28*a*, 28*b*, and parallel to the respective link beams 14*a*, 14*b*. In the illustrative example, the connection plates 16 and 18 are placed equidistant from one another relative to the center line of the plate assembly.

Illustrated in FIG. 3*a*, is a top view of the pin assembly 20 used to connect the plates 16*a*, 16*b* and 18*a*, 18*b*. This view illustrates how the pin 21, which is a threaded steel rod in the example, is fastened to the connection plates 16*a*, 16*b* and 18*a*, 18*b* with steel nuts 22 over steel washers 24. Brass shims 26 are placed between steel washers 24 and connection plates 16*a*, 16*b* and 18*a*, 18*b*.

Figure 4:
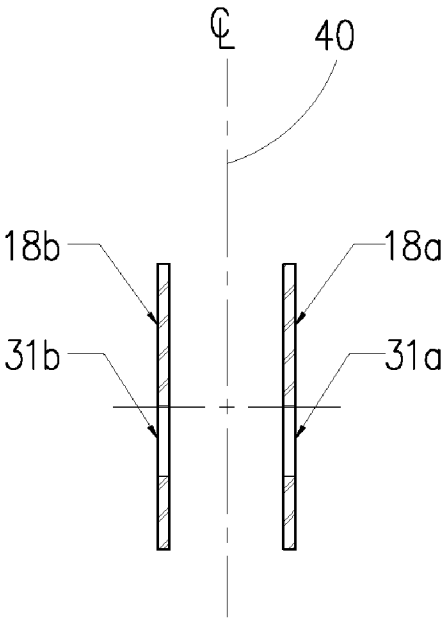
FIG. 4 is a cross sectional view of the plate assembly of FIG. 2 taken along line IV-IV'.

FIG. 4 is a cross sectional view of the plate assembly 18 of FIG. 2 taken along line IV-IV'. The section illustrates the cross-section of the outer connection plates 18*a*, 18*b*. In addition, this view illustrates the position of the diagonal slots 31*a*, 31*b* relative to the horizontal center line axis 40 of the beam 14*a* taken along line IV-IV'.

Figure 5:
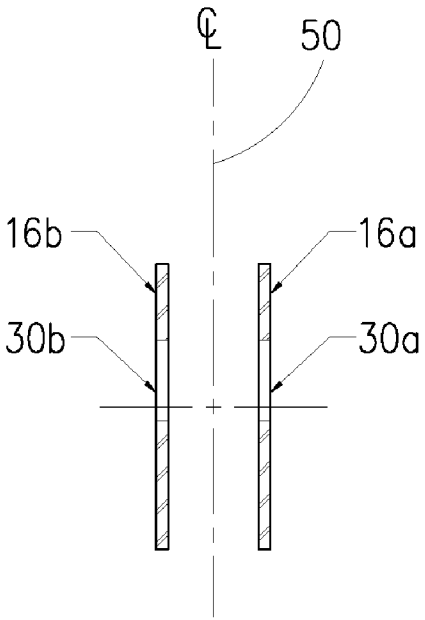
FIG. 5 is a cross sectional view of the plate assembly of FIG. 2 taken along line V-V'.

FIG. 5 is cross sectional view of the plate assembly 16 of FIG. 2 taken along line V-V'. The section illustrates the cross-section of the inner connection plates 16*a*, 16*b*. This view illustrates the position of the diagonal slots 30*a*, 30*b* relative to the horizontal center line axis 50 of the beam 14*b* taken along V-V'.

Figure 6:
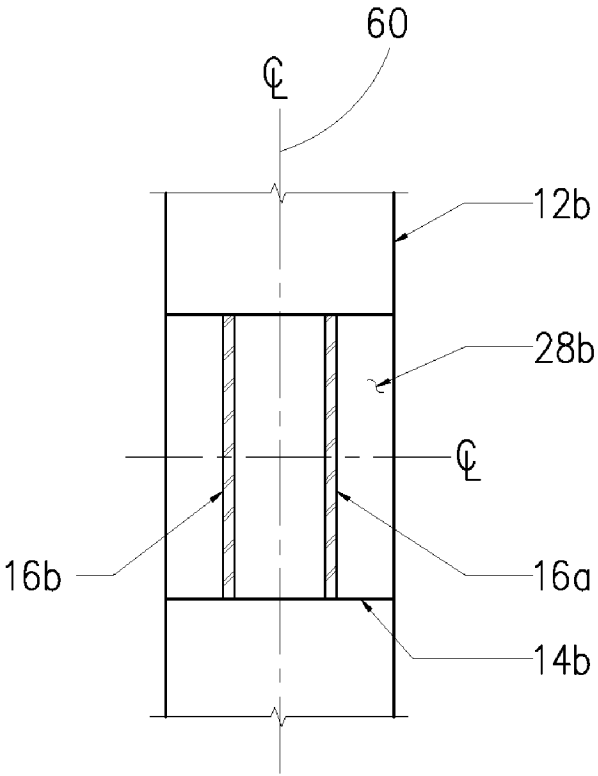
FIG. 6 is a cross sectional view of the plate assembly of FIG. 2 taken along line VI-VI'.

FIG. 6 is a cross sectional view of the plate assembly 16*a*, 16*b* of FIG. 2 taken along line VI-VI'. This view illustrates the connection of plates 16*a*, 16*b* normal to the embedded steel plate 28 with their position relative to the centering axis 60 of beam 14*b* and wall 12*b* beyond.

FIG. 7 is a top view of the completed pin assembly 20 used to connect inner connection plates 16*a*, 16*b* and outer connection plates 18*a*, 18*b* utilizing a single steel threaded thru-rod 21. This illustrative pin assembly includes a completely threaded steel rod 21, steel nuts 22 used for torquing the rod, steel washers 24, and brass shims 26. FIG. 7*a* is a side view of the completed pin assembly 20.

FIG. 8 is a top view of another embodiment of the completed pin assembly 20 used to connect inner connection plates 16*a*, 16*b* and outer connection plates 18*a*, 18*b* utilizing multiple steel threaded thru-rods 32. This pin assembly includes multiple threaded steel rods 32, steel nuts 33 used for torquing the rods, steel washers 24, brass shims 26, and a steel spacer plate 36 used to keep the rods aligned. Spacer plate 36 may use standard diameter holes to match the rod diameter. FIG. 8*a* is a side view of the completed pin assembly 20 that utilizes multiple steel threaded thru-rods 32.

FIG. 9 is a top view of yet another embodiment of the completed pin assembly 20 used to connect inner plates 16*a*, 16*b* and outer plates 18*a*, 18*b* utilizing multiple high-strength steel bolts 34. This pin assembly includes high-strength steel bolts with threads excluded from the shear plane 34, steel nuts 35 used for torquing the bolts, steel washers 24, and brass shims 26. FIG. 9*a* is a side view of the completed pin assembly 20 that utilizes multiple high-strength steel bolts 34.

Figure 10:
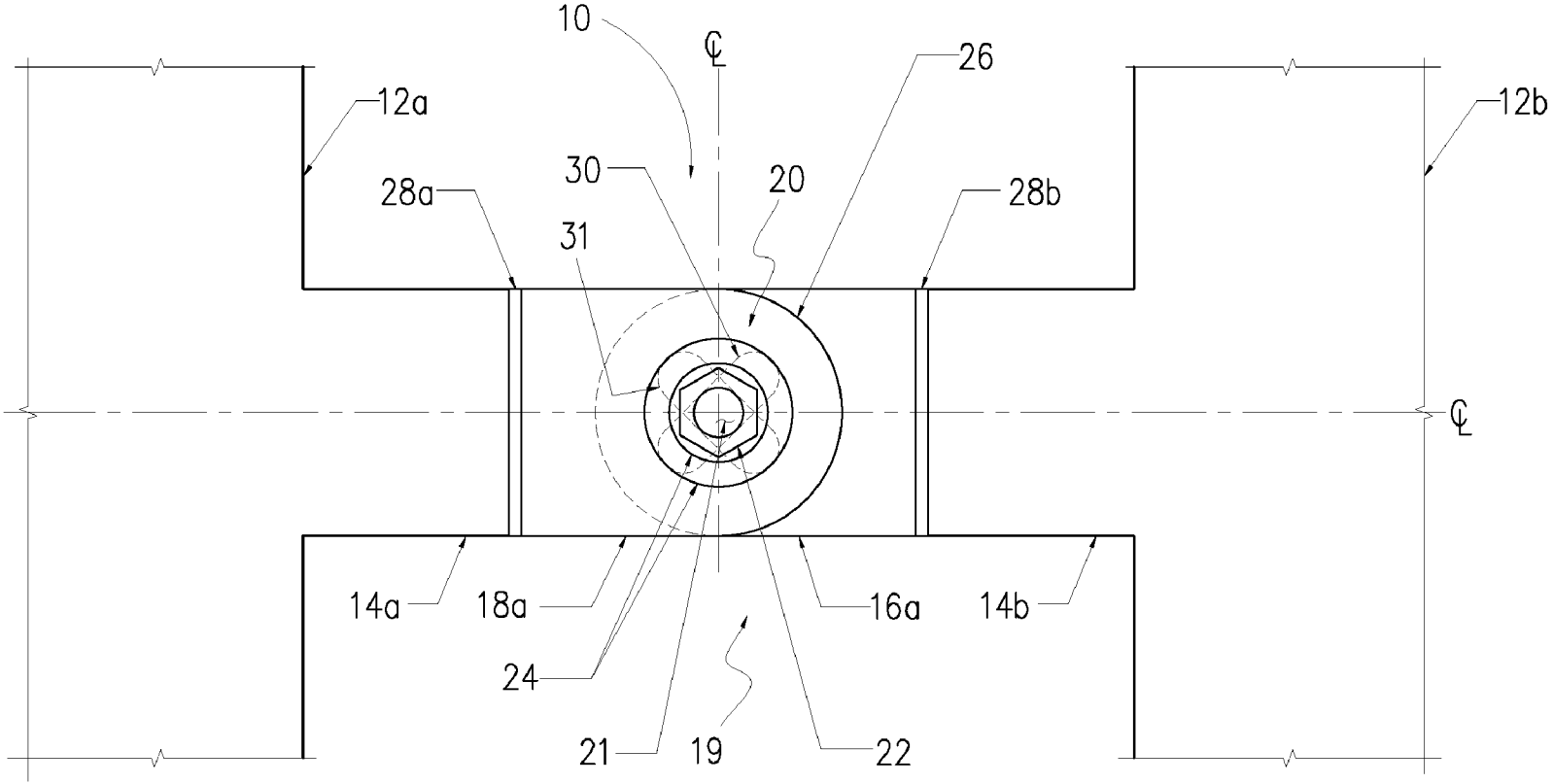
FIG. 10 is a front view of one embodiment of the link joint assembly consistent with the present invention.

FIG. 10 is a front view of one embodiment of the link beam joint assembly 10 as it would appear with the connection plates 16*a*, 16*b* and 18*a*, 18*b* connected via the link-fuse joint 19. This view illustrates the placement of the pin assembly 20 through connection plates 16*a*, 16*b* and 18*a*, 18*b*. This connection may be accomplished, for example, with a single thru-rod 21, multiple thru-rods 32, or multiple high-strength bolts 34. As explained previously, the diagonally opposed slots 30 and 31 in the connection plates 18*a*, 18*b* and 16*a*, 16*b*, respectively, allow the connection plates to slide relative to one another when subject to extreme seismic loads. As the connection plates move, they are held together via the pin 20, yet are enabled to move as the pin 20 travels within the slots. The slipping that occurs between the plates 16*a*, 16*b* and 18*a*, 18*b* transfers to embedded plates 28*a*, 28*b*, thereby dissipating energy at the joint 19.

To control slippage between the connection plates 16*a*, 16*b* and 18*a*, 18*b*, when subject to standard load conditions, such as wind, gravity and moderate seismic events, one or more brass shims 26 may be placed, for example, between the connection plates and/or between the connection plates and adjacent washers. The coefficient of friction of the brass, or other material that is used, against the cleaned mill surface of structural steel, or other material, is very well understood and can be accurately predicted. For example, the shear force that will initiate slip can be determined using Equation 1 below:

$$F=\mu_s N \qquad \text{(Equation 1)}$$

where, F is the shear force that will initiate slip, $\mu_s$ is the coefficient of static friction (e.g., 0.30 for brass clamped between steel plates), and N is the clamping force introduced into the connection by the torquing the thru-rod 21 or 32 or bolts 34. Thus, the amount of shear that the joint 19 can bear before a slip or rotation will occur between connection plates 16*a*, 16*b* and 18*a*, 18*b* can be determined.

Further, bolt tensioning in the steel bolts 21, 32 or 34 is not lost during the slipping process. Therefore, the frictional resistance of the joint 19 is maintained after the shear wall/link beam/joint motion comes to rest following the slippages between the connections plates 16*a*, 16*b* and 18*a*, 18*b*. Thus, the link-fuse joint 19 should continue not to slip during moderate loading conditions, even after undergoing extreme seismic activity.

Figure 11:
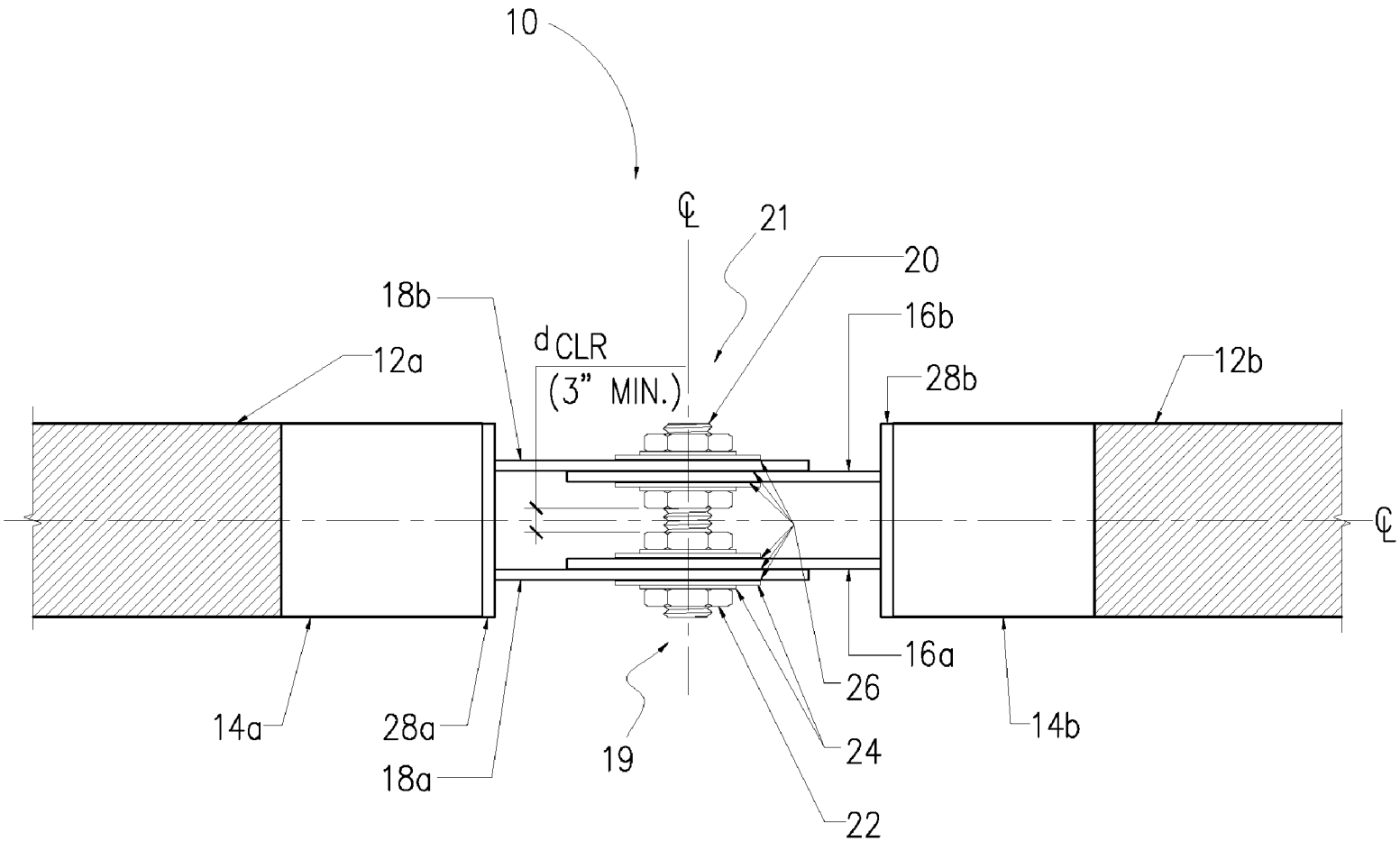
FIG. 11 is a top view of one embodiment of the link joint assembly consistent with the present invention.

FIG. 11 is a top view of one embodiment of the link beam joint assembly 10. This view illustrates the positioning of the connection plates 16*a*, 16*b* and 18*a*, 18*b*, relative to one another, when the joint 19 is connected, as well as embedded plates 28. As shown in this illustrative example, shims 26 may be positioned, for example, between the connection plates (e.g., between connection plate 16*a* and connection plate 18*a*), between the connection plates and interior washers (e.g., between connection plate 16*b* and washer 24), and/or between the connection plates and exterior washers (e.g., between connection plate 18*b* and washer 24.)

Figure 12:
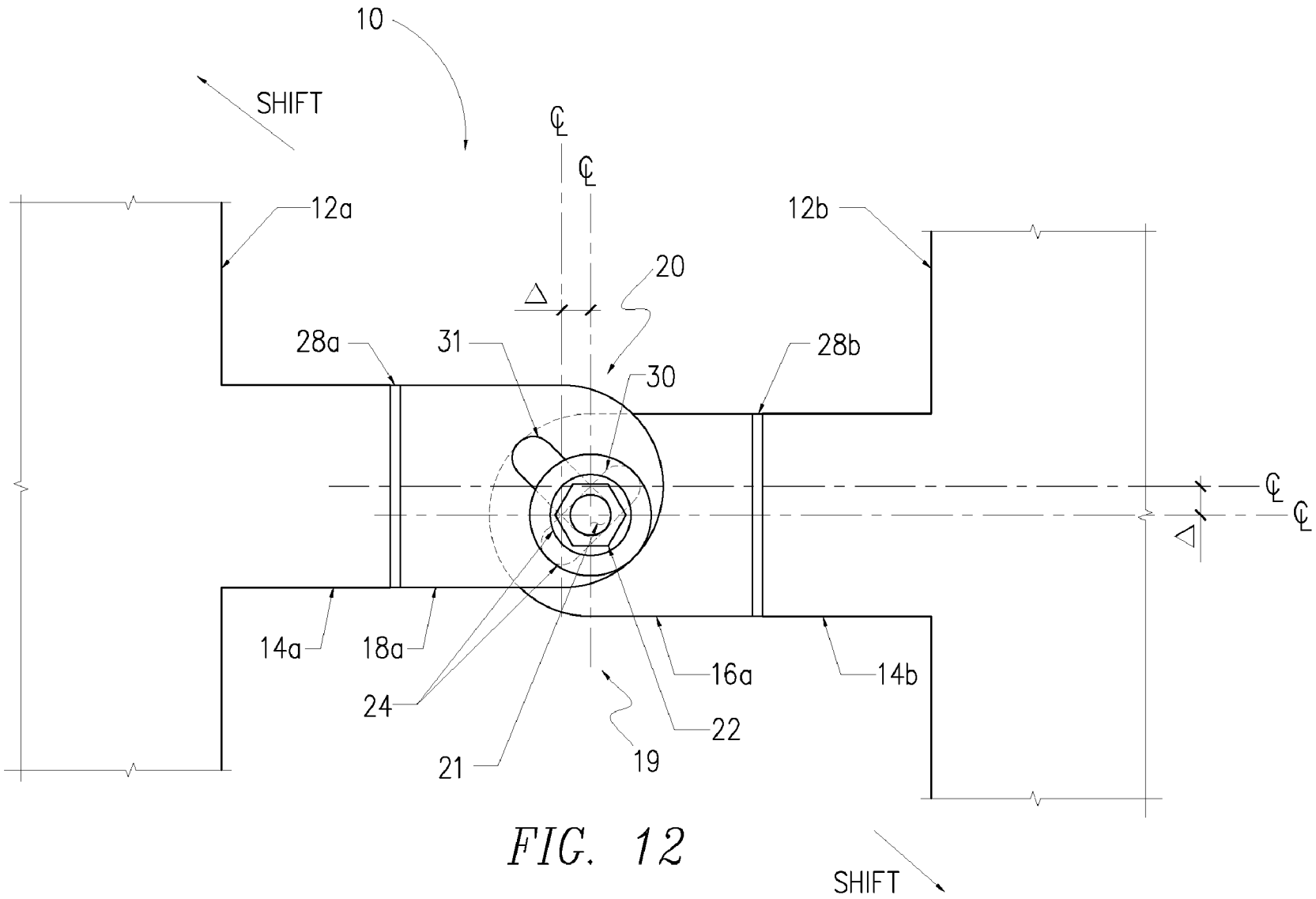
FIG. 12 is a front view of the link beam joint assembly consistent with the present invention as it would appear with the link-fuse joint displaced when subject to extreme loading conditions.
Figure 13:
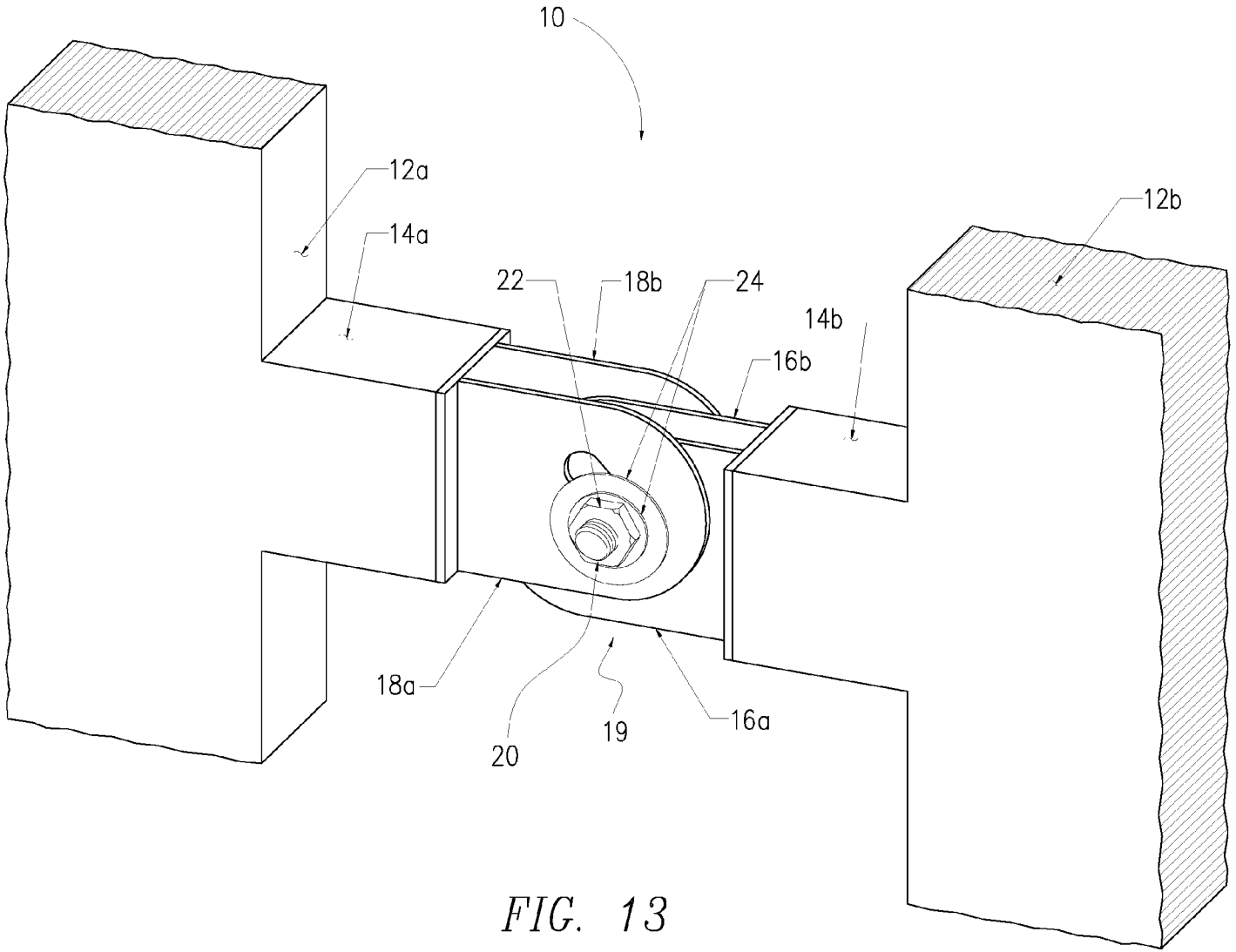
FIG. 13 is a perspective view of the link beam joint assembly consistent with the present invention as it would appear with the link-fuse joint displaced when subject to extreme loading conditions.

FIG. 12 is a side view and FIG. 13 is a perspective view of the link-fuse joint 19 as it would appear slipped when placed under a severe seismic load. When subject to seismic loads, shear forces and bending moments are introduced into the wall 12*a*, 12*b* from ground motions due to seismic activity. When the loads are extreme, the link-fuse joint 19 will slip, as shown in FIG. 12 and FIG. 13. The joint 19 will slide about the pin 21 (or 32 or 34) connection, which is created through the introduction of the pin assembly 20 into the connection plates 16*a*, 16*b* and 18*a*, 18*b* while using diagonally opposed slots 30 and 31. Shear loads are transferred to the link beam 14*a*, 14*b* then to the shear wall 12*a*, 12*b* through this pin connection. In the illustrative example, the wall 12*a* has shifted, for example, toward the upper left relative to the joint 19, such that the pin 21 has slid to the base of slot 31, while the pin 21 has not changed position within slot 30. The pin 21 could however change position within slot 30 during overall shifting of the structure. Thus, the diagonally opposed slots enables the pin 21 to maintain a connection within the joint 19 when the walls 12*a*, 12*b* move relative to each other.

Accordingly, with the slip of the link-fuse joint, energy is dissipated. The dynamic characteristics of structure are thus changed during a seismic event once the onset of slip occurs. This period is lengthened through the inherent softening, i.e., stiffness reduction, of the structure, subsequently reducing the effective force and damage to the structure.

The foregoing description of an implementation of the invention has been presented for purposes of illustration and description. It is not exhaustive and does not limit the invention to the precise form disclosed. Modifications and variations are possible in light of the above teachings or may be acquired from practicing the invention. The scope of the invention is defined by the claims and their equivalents.

For example, other applications of the link-fuse joint 19 within a building frame may include the introduction of the joint 19 into other structural support members in addition to the beam, such as the shear wall 12, primarily at the base of the shear walls 12. Other materials may be considered for the building frame and joint 10, including, but are not limited to, composite resin materials such as fiberglass. Alternate structural steel shapes may also be used in the link-fuse joints 19, including, but not limited to, built-up sections, e.g., welded plates, or other rolled shaped such as channels. Alternative materials (other than brass) may also be used between the connection plates 16*a*, 16*b* and 18*a*, 18*b* to achieve a predictable slip threshold. Such materials may include, but not be limited to, Teflon, bronze or steel with a controlled mill finish. Steel, Teflon, bronze or other materials may also be used in place of the brass shims 26 in the plate end connection.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A joint connection comprising:

a first plate assembly having a first connection plate including a first diagonal slot formed therethrough;

a second plate assembly having a second connection plate including a second diagonal slot formed therethrough, the second diagonal slot being diagonally opposed to the first diagonal slot, the second connection plate being positioned such that at least a portion of the second diagonal slot aligns with a portion of the first diagonal slot; and a pin positioned through the first diagonal slot and the second diagonal slot, the joint connection accommodating a slippage of at least one of the first and second plate assemblies relative to each other when the joint connection is subject to a seismic load and without significant loss of clamping force.

2. The joint connection of claim 1, wherein the first connection plate comprises a plurality of first connection plates, each of the plurality of first connection plates having a diagonal slot formed therethrough, the diagonal slots of the plurality of first connection plates being aligned with each other.

3. The joint connection of claim 1, wherein the second connection plate comprises a plurality of second connection plates, each of the plurality of second connection plates having a diagonal slot formed therethrough, the diagonal slots of the plurality of second connection plates being aligned with each other.

4. The joint connection of claim 1, wherein the first plate assembly is connected to a first support member and the second plate assembly is connected to a second support member.

5. The joint connection of claim 4, wherein at least one of the first support member and the second support member is a beam.

6. The joint connection of claim 4, wherein at least one of the first support member and the second support member is a shear wall.

7. The joint connection of claim 4, wherein at least one of the first support member and the second support member is made of structural steel.

8. The joint connection of claim 4, wherein at least one of the first support member and the second support member is made of reinforced concrete.

9. The joint connection of claim 4, wherein at least one of the first support member and the second support member is made of composite material.

10. The joint connection of claim 1 further comprising:

a shim positioned between the first connection plate and the second connection plate.

11. The joint connection of claim 10, wherein the shim comprises brass.

12. The joint connection of claim 10, wherein the shim comprises steel.

13. The joint connection of claim 10, wherein the shim comprises Teflon.

14. The joint connection of claim 10, wherein the shim comprises bronze.

15. The joint connection of claim 1, wherein the pin comprises one of a threaded steel rod, a plurality of threaded steel rods, and a plurality of high-strength bolts.

16. The joint connection of claim 1, wherein each of the first and second plate assemblies are configured to be attached to a respective link beam such that each of the first and second connection plates extend from and are parallel to the link beam to which the respective plate assembly is attached, and the first and the second diagonal slots enable the pin to travel laterally and vertically within a respective one of the slots in response to a corresponding seismic induced movement of one of the link beams.

17. The joint connection of claim 16, further comprising:

a shim positioned between the first connection plate and the second connection plate and having an opening through which the pin is disposed, the shim being configured to inhibit travel of the pin within either of the slots when the pin is subject to a shear force at or below a predetermined level.

* * * * *